United States Patent [19]

Tsukamoto

[11] Patent Number: 5,004,240

[45] Date of Patent: Apr. 2, 1991

[54] GOLF BALL RETRIEVER

[76] Inventor: Jack K. Tsukamoto, 1976 Paula Dr., Honolulu, Hi. 96816

[21] Appl. No.: 510,559

[22] Filed: Apr. 18, 1990

[51] Int. Cl.[5] ..... A63B 53/00; A63B 53/14

[52] U.S. Cl. ..... 273/162 E; 294/19.2

[58] Field of Search ..... 273/162 E, 32 F, 162 R, 273/162 F, 162 D; 294/19.2

[56] References Cited

U.S. PATENT DOCUMENTS

| | | | |
|---|---|---|---|
| 802,264 | 10/1905 | Brown | 294/19.2 |
| 1,175,035 | 3/1916 | Wooster | 294/19.2 |
| 2,320,611 | 6/1943 | Kandle | 294/100 |
| 2,658,785 | 11/1953 | Jones | 294/19.2 |
| 2,739,331 | 3/1956 | Goodman | 273/81.2 |
| 3,038,751 | 6/1962 | Stafford | 294/19.2 |
| 3,093,402 | 6/1963 | Sisso | 294/19.2 |
| 3,318,628 | 5/1967 | White | 273/162 E |
| 3,698,720 | 10/1972 | Gudmundsen | 273/162 E |

*Primary Examiner*—George J. Marlo

*Attorney, Agent, or Firm*—Banner, Birch, McKie & Beckett

[57] ABSTRACT

A golf ball retriever includes a self-contained module having a plurality of curved, resilient prongs in the form of cantilevered springs and a housing with a side wall, an open end and a closed end. An end cap having an aperture associated with each prong is disposed across the open end of the housing and retains the prongs. One of the prongs has a shoulder cooperating with a portion of the end cap to form a latching mechanism. A push button arrangement disengages the latching mechanism allowing an axial compression spring to move the prongs from a first position having the prongs substantially disposed within the housing to a second position having the prongs substantially extending from and through the housing's open end. The resilient, elastic prongs bias the push button arrangement toward a latched position. The cantilevered configuration of the prongs places them in a biased relationship with the side wall of the housing and urges the prongs toward the second, extended position. The cooperation between the bias of prongs and the bias of the axial spring permits actuation of the golf ball retriever using an axial spring having a smaller spring rate and a shorter length than required to fully extend the prongs if the spring rate of the prongs were not present.

15 Claims, 3 Drawing Sheets

GOLF BALL RETRIEVER

TECHNICAL FIELD

The invention relates to golfing equipment, and more particularly to a combined golf club and ball retriever for retrieving golf balls.

BACKGROUND OF THE INVENTION

The game of golf is generally non-strenuous and is enjoyed by players of all ages in various levels of physical condition. One aspect of the game of golf can be particularly strenuous, however. That aspect is the retrieval of a golf ball, which can occur frequently, i.e., at the conclusion of play at each hole or retrieving the ball from various greens or hazards disposed along the golf course. For the older or infirm player it becomes particularly difficult to bend over and pick up a golf ball from the ground, to retrieve a golf ball from the cup or to retrieve a ball from a water trap. To ameliorate this strenuous aspect of the game of golf, it becomes necessary to conceive of a device which will aid a player who wants or needs help in ball retrieval to recover his or her ball.

Uyei in U.S. Pat. No. 1,658,145 provides a device that allows players to pick up golf balls from the ground without bending over and picking them up by hand. A plurality of flexible, resilient, curved spring fingers are provided at the end of the golf club proximal to the handle. Using this device, which has flexible fingers that permanently protrude from the end of the golf club, may cause a different problem to arise. These permanently protruding fingers may make it awkward to grip the club while playing.

McEvoy in U.S. Pat. No. 2,801,875 discloses a golf ball retriever which is adapted to be readily mounted in position for use on the usual handle of any conventional golf club. The golf ball retriever is removably clamped into position on the club handle. However the use of a removable device creates a different problem; it may be forgotten or lost thereby requiring the user to have a plurality of golf ball retrievers, or else the original problem arises again.

Gudmundsen in U.S. Pat. No. 3,698,720 provides a golf ball retriever having a plurality of resilient tines which can be extended from and retracted into the golf club. This retrofittable golf ball retriever is not easily lost because once it is fitted into the club, it becomes an integral part of the club. However, the tines must be grasped by hand and pulled from the retracted to the extended position. This may be a difficult operation to perform for the older or infirm golf player.

White in U.S. Pat. No. 3,318,628 provides a combined golf club and ball retriever having a plurality of curved fingers that move from a retracted to an extended position to retrieve a golf ball. A knob and slide assembly cause the movement of the curved fingers. The White device has a disadvantage of not being automatically actuated.

Brown in U.S. Pat. No. 802,264 discloses a golfing club and appliance having a series of spring-arms movable from a retracted position to an extended position to retrieve a golf ball when desired. The appliance may be actuated by pressing a button projection which allows the recoil action of a spring to automatically press the arms without the golf club. The Brown appliance is disadvantageous because it requires a large spring whose length is substantially over half the length of the club and is a cumbersome design which is apparently unfeasible for a retrofit assembly. The Brown appliance apparently would have to be configured in the golf club at the time of manufacture.

The prior art fails to contemplate a self-contained module for use with a golf club to form a golf ball retriever which is small and retrofittable as well as not cumbersome to use.

SUMMARY OF THE INVENTION

The invention relates to a combined golf club and ball retriever for retrieving golf balls comprising a small self-contained module which may be installed during the manufacture of a golf club or easily retrofitted on a golf club at some time after purchase. The self-contained module includes a housing having a side wall, a closed end and an open end. An end cap is disposed across the open end of the housing to secure the prongs to the module. A plurality of prongs or tines function as cantilevered springs and are each connected and circumferentially disposed about one end of a solid core. Connected to the other end of the solid core is an axial compression spring whose free end seats against the closed end of the housing. One of the prongs is provided with a shoulder mating with a portion of the end cap to form a latching mechanism. The latching mechanism holds the prongs in a retracted position out of the way when using the club. The curved prongs in the retracted position have a biased relation with the side wall of the module. This biased relation creates a lateral biasing force against a push button, thereby biasing the push button laterally outwardly. The user actuates the golf ball retriever by applying a force against the push button sufficient to overcome the lateral bias of the latch mechanism. With the latch mechanism disengaged the axial spring moves the prongs from the first, retracted position towards a second position having the prongs substantially extending from and through the open end of the module. The prongs have an exaggerated S-curve shape which facilitates elastic deformation over and about a golf ball. A crown having a periphery of four edges or two pairs of opposing edges is disposed about the open end of the housing. One pair of the opposed edges rises to a greater height than the other pair of opposed edges. The raised pair of opposed edges protects the prongs from casual abrasion or injury, when the prongs are in the retracted position. The recessed pair of opposed edges facilitate placing the prongs in the retracted position when it is not desired to use the golf ball retriever.

Various advantages and features of novelty which characterize the invention are pointed out with particularity in the claims annexed hereto and forming a part hereof. However, for better understanding of the invention, its advantages, and objects obtained by its use, reference should be had to the drawings which form a further part hereof, and to the accompanying descriptive matter, in which there is illustrated and described a preferred embodiment of the invention.

DETAILED DESCRIPTION OF THE INVENTION

Figure 1:
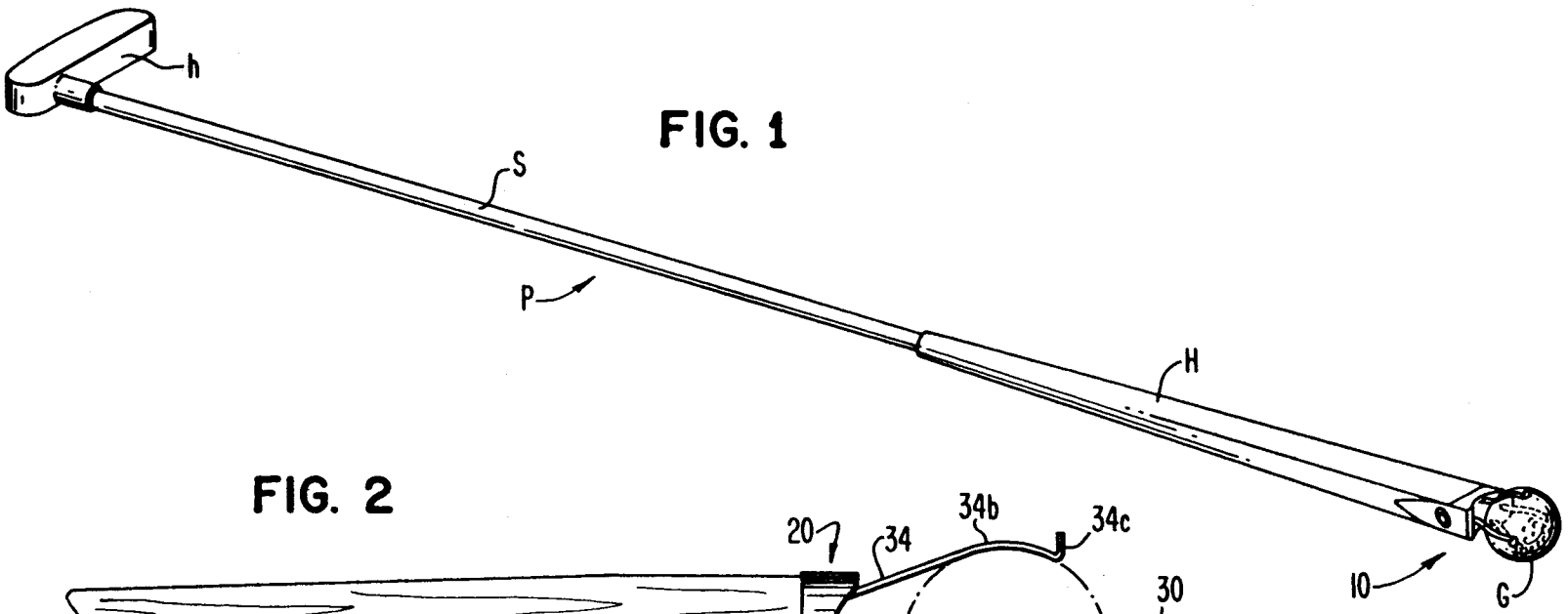
FIG. 1 is a perspective view of a golf ball retriever embodying the present invention.

Referring to the drawings wherein like numerals indicate like elements, the golf ball retriever 10 in accordance with the present invention is shown in FIG. 1.

FIG. 1 is a perspective view of a golf club or putter P having a shaft S with a head h disposed at one end of the shaft and a handle H disposed at the other end of the shaft. The golf ball retriever 10 is disposed at the end of the handle H distal from the head h of the putter P. Golf ball retriever 10 is shown in an extended position holding a golf ball G. Preferably, the retriever replaces the existing handle and a small portion of the club shaft, which may vary according to the preference of the golfer. The retriever may be detachable from the golf club, but preferably the retriever is permanently affixed using epoxy or a similar bonding agent.

Figure 2:
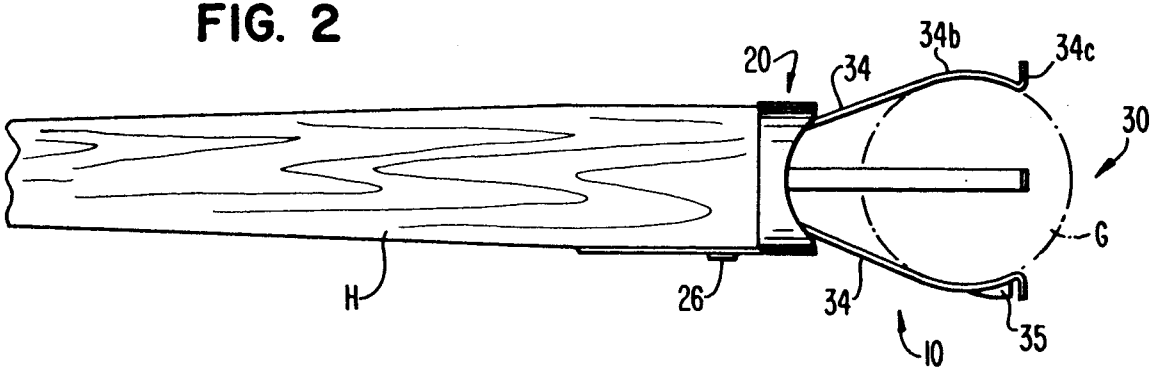
FIG. 2 is an elevational view of one side of the golf ball retriever shown in FIG. 1 with the prongs extended.

FIGS. 1 and 2 illustrate golf ball retriever 10 including a housing 20 and a prong assembly 30. Housing 20 has a button 26 which is depressed to extend prong assembly 30. Prong assembly 30 includes a plurality, preferably four, of prongs 34. One prong 34 has a prong shoulder 35. Preferably the exposed surfaces of the prong shoulder form a 90° angle. Each prong is preferably made of flat spring steel. The visible portion of the prong appears in its extended position as an exaggerated S-curve, the top or outer most curve being tightly formed in an arc having a convex angle which faces the longitudinal axis of the shaft S. This curve reverses sharply and opens into the larger lower curve, the concave angle of which faces the longitudinal axis of the shaft S and approximates the curvilinear shape of a golf ball. It is the smaller, convex angle that first engages the golf ball and directs the prongs outward along the surface of the ball. The larger, convex angles of the prongs 34, acting together, encircle the golf ball in a semi-closed pocket or cupped space.

Figure 3:
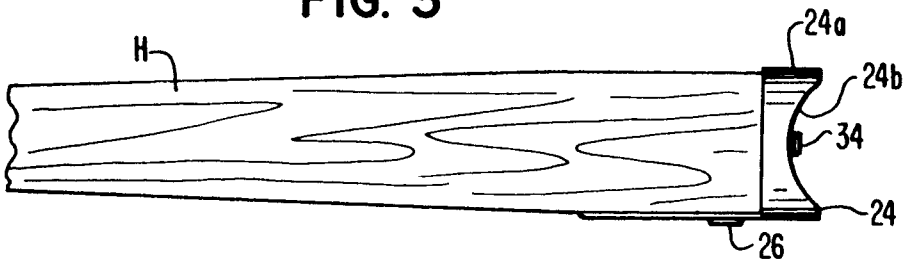
FIG. 3 is an elevational view of the golf ball retriever shown in FIG. 1 with the prongs retracted.

FIG. 3 illustrates the prongs in a retracted position and a crown 24 which is part of housing 20. The crown may be made of any conventional material, such as a metal, plastic resin, or composite material, that will withstand casual abrasion or shock. Preferably the crown is incorporated in a one-piece housing and made of injection molded plastic that is later machined as necessary if a fastening mechanism is used with an end cap. The crown 24 includes a pair of opposed, raised edges **24*a* and a pair of opposed, lower edges 24*b*. When the prongs 34 are in the retracted position, the tip 34*c* of each prong is protected from damage, which might result from bumping the club handle against other clubs or the sides or bottom of a golf club bag, by the raised edges 24*a*. The recessed pair of opposed edges facilitate placing prong 34** in the retracted position when it is not desired to use the golf ball retriever.

Figure 4:
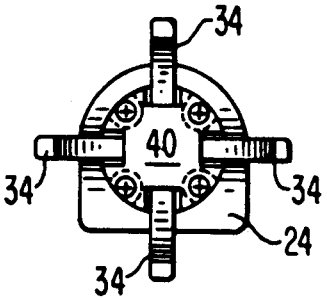
FIG. 4 is a top view of the golf ball retriever shown in FIG. 1 with the prongs extended.
Figure 5:
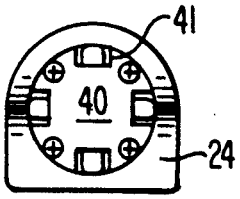
FIG. 5 is a top view of the golf ball retriever shown in FIG. 1 with the prongs retracted.
Figure 6:
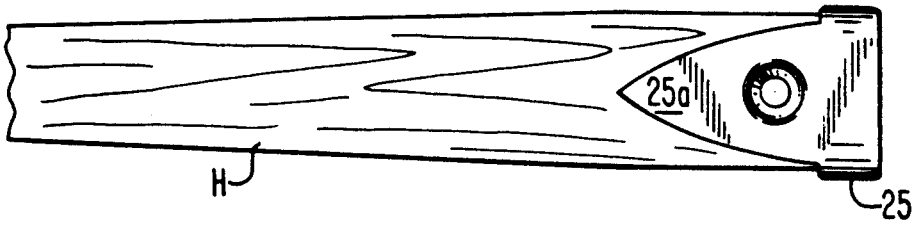
FIG. 6 is a partial elevational view of another side of the invention shown in FIG. 1 with the prongs in a retracted position.
Figure 10:
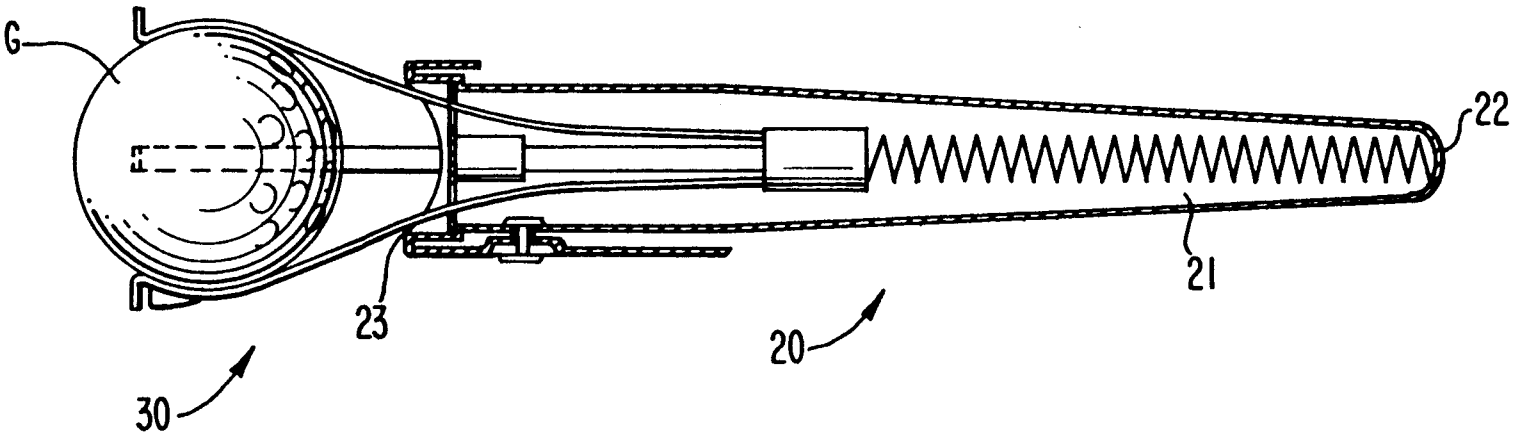
FIG. 10 is an elevational view of the self-contained module of the invention shown in FIG. 1 with the prongs extended.

FIGS. 4 and 5 illustrate an end cap 40 which is connected to housing 20 in any conventional manner. Preferably the end cap is removable and may be attached to the module by a plurality of threaded fasteners passing through holes in the end cap. End cap 40 secures the prong assembly 30 within housing 20. FIG. 6 illustrates a side wall 25 of crown 24 and a flange **25*a* which depends from side wall 25. As best seen in FIG. 10, housing 20 includes a side wall 21, a closed end 22 and an open end 23. Preferably, side wall 21** is tapered to diverge in the direction from the closed end to the open end. It is preferable for the end cap to be removable to facilitate cleaning, repair or replacement of the mechanism.

Figure 7:
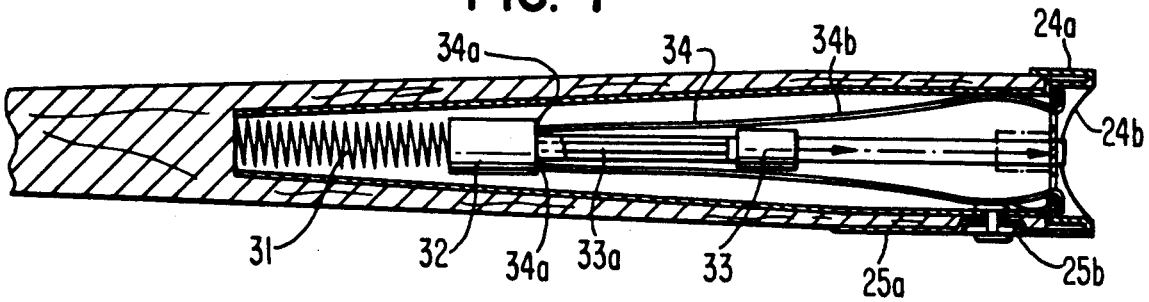
FIG. 7 is a cross-sectional view of the self-contained module of the invention shown in FIG. 1 with the prongs retracted.

FIG. 7 illustrates the internal details of the prong assembly 30. Prong assembly 30 includes an axial compression spring 31 connected to one side of a core 32 and a plurality of prongs 34 connected to the other side of core 32. Preferably, the prongs are fixedly attached at their lower ends in a cantilevered fashion to the top of the core 32, which is preferably a solid cylinder. A rod **33*a* having a keeper 33 disposed on the free end thereof, is surrounded by prongs 34 and is connected to a central portion of core 32. This rod 33*a* is shorter than the prongs 34. When the latch button 26 is pressed, each prong extends through an associated aperture 41 in the end cap. This keeper contacts a central portion of the underside of the end cap 40, thus limiting the axial movement of the prongs. The keeper 33** is preferably made of a soft rubber or synthetic material. It is contemplated to make the keeper of a conventional material including hard materials such as metal. Experience has shown that use of a hard material for the keeper results in a disconcerting loud click when the keeper contacts the end cap.

FIG. 4 shows the distance between opposing prong tips **34*c* is greater than the width of housing 20 when the prongs are in the extended position. FIGS. 5 and 7 illustrate the prongs 34 in the retracted position and contacting side wall 21 of housing 20 under tension created by compressing prongs 34 laterally inwardly to fit within housing 20. This tension creates a lateral biasing force that biases button 26** outwardly and an axial biasing force that biases the prongs toward the open end of the housing.

Figure 8:
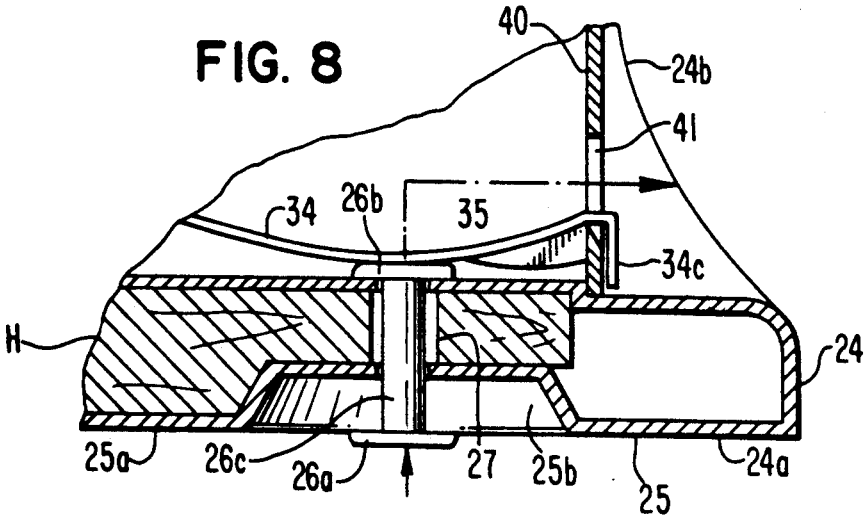
FIG. 8 is an enlarged cross-sectional view of the self-contained module of the invention shown in FIG. 1 with the prongs retracted.

FIG. 8 illustrates an enlarged portion of the golf ball retriever. Button 26 includes an exposed head **26*a* connected to an inner head 26*b* via a shaft 26*c* disposed and retained in a through hole 27. The prong assembly is latched in the retracted position by the cooperation between prong shoulder 35 and a lip or portion of end cap 40. The tensioned relationship between the side wall 21 of the housing 20 and the prongs 34 serves to bias the button 26 outwardly. Flange 25*a* has a depression 25*b* to provide space for the button 26 to move from a first, biased position to a second, depressed position. When a force sufficient to overcome the biasing of prong 34 is applied to button 26, the button moves from the first, biased position to the second, depressed position. Depressing button 26 causes inner head 26*b* to move prong shoulder 35 out of contact with end cap 40. Once unlatched, prong assembly 30 moves from the first, retracted position to a second, extended position under the force of axial compression spring 31**.

Figure 9:
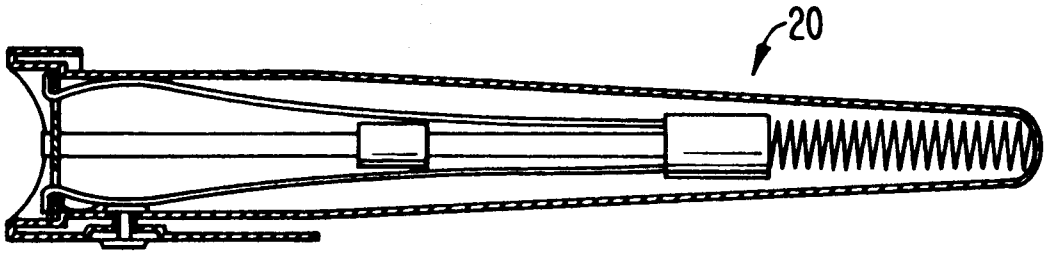
FIG. 9 is an elevational view of the self-contained module of the invention shown in FIG. 1 with the prongs retracted.

FIG. 9 shows prong assembly 30 in the first retracted position and FIG. 10 illustrates the prong assembly 30 in the second extended position.

Numerous characteristics, advantages, and embodiments of the invention have been described in detail in the foregoing description with reference to the accompanying drawings. However, the disclosure is illustrative only and the invention is not limited to the precise illustrated embodiment. Various changes and modifications may be effected therein by one skilled in the art without departing from the scope or spirit of the invention.

I claim:

1. A retrofittable module for use with a golf club to retrieve golf balls, said retrofittable module comprising:

an elongated housing having a side wall, a closed end, and an open end;

a plurality of curved, resilient prongs;

connecting means for connecting said prongs together;

axial biasing means contacting said housing for biasing said prongs in an axial direction parallel to the longitudinal axis of the housing toward said open end; and actuating means for actuating said module from a first position having said prongs substantially disposed within said housing wherein said prongs are in a biased relationship with said side wall to a second position having said prongs substantially extending out of said housing through said open end, wherein movement from said first position to said second position results from the cooperation between said axial biasing means and said biased relationship between said prongs and said side wall.

2. The retrofittable module according to claim 1, wherein said module includes:

a keeper for limiting the axial movement of said prongs; and a rod connected at one end to said connecting means and at the other end to said keeper.

3. The retrofittable module according to claim 2, wherein said keeper is made of rubber.

4. The retrofittable module according to claim 1, wherein said housing includes a crown having a pair of opposing, raised edges and a pair of opposing, lower edges.

5. The retrofittable module according to claim 4, wherein said crown includes a flange having a depression; and at least a portion of said actuating means is disposed within said depression.

6. The retrofittable module according to claim 1, wherein:

said connecting means includes a core;

said axial biasing means includes a spring; and said spring contacts said closed end of said housing and is connected to said core.

7. The retrofittable module according to claim 1, wherein said side wall includes a taper.

8. The retrofittable module according to claim 7, wherein said taper diverging in the direction from said closed end to said open end.

9. The retrofittable module according to claim 1, wherein said module is substantially disposed within the golf club.

10. A module comprising:

a housing having a side wall, a closed end, and an open end;

a plurality of curved, resilient prongs;

connecting means for connecting said prongs together in a cantilevered fashion;

axial biasing means for biasing said prongs in an axial direction toward said open end;

retaining means for retaining said prongs in a first position having said prongs substantially disposed within said housing;

releasing means for releasing said prongs from said first position; and lateral biasing means for biasing said releasing means toward a latched position;

wherein a force applied to said releasing means sufficient to overcome the biasing force of said lateral biasing means moves said releasing means from said latched position to an unlatched position thereby releasing said prongs from said first position.

11. The module according to claim 10, wherein said side wall includes a taper.

12. The module according to claim 11, wherein said taper diverges in the direction from said closed end to said open end.

13. The module according to claim 10, wherein said releasing means includes a button having an exposed head, an inner head contacting one of said prongs and a shaft connecting said heads.

14. The module according to claim 10, wherein said module includes:

an end cap disposed across said open end of said housing; and said retaining means includes a shoulder disposed on one of said prongs; said shoulder mating with a portion of said end cap to retain said prongs in said first position.

15. The module according to claim 10, wherein said module is adapted for use with a golf club, said module being substantially disposed within the golf club.

* * * * *